United States Patent [19]

Hansen

[11] Patent Number: 5,064,362

[45] Date of Patent: Nov. 12, 1991

[54] BALANCED DUAL-LOBE VANE PUMP WITH RADIAL INLET AND OUTLET PARTING THROUGH THE PUMP ROTOR

[75] Inventor: Lowell D. Hansen, Jackson, Miss.

[73] Assignee: Vickers, Incorporated, Troy, Mich.

[21] Appl. No.: 590,336

[22] Filed: Sep. 28, 1990

Related U.S. Application Data

[63] Continuation of Ser. No. 356,228, May 24, 1989, abandoned.

[51] Int. Cl.[5] ..... F04C 15/02

[52] U.S. Cl. ..... 418/186; 418/15

[58] Field of Search ..... 418/186, 266, 267, 268, 418/269, 187, 188, 15

[56] References Cited

U.S. PATENT DOCUMENTS

| | | | |
|---|---|---|---|
| 1,792,026 | 2/1931 | Nichols | 418/186 |
| 1,913,758 | 9/1933 | Hapkins | 418/266 |
| 2,348,428 | 5/1944 | Tucker | 418/186 |
| 2,736,267 | 2/1956 | Mosbacher | 418/186 |
| 2,985,110 | 5/1961 | Burt et al. | 418/188 |
| 3,256,831 | 6/1966 | Eickmann | 418/186 |
| 3,639,091 | 2/1972 | Lewicki | 418/267 |

FOREIGN PATENT DOCUMENTS

| | | | |
|---|---|---|---|
| 2752718 | 8/1978 | Fed. Rep. of Germany | 418/15 |
| 1242629 | 7/1986 | U.S.S.R. | 418/186 |

*Primary Examiner*—Richard A. Bertsch
*Assistant Examiner*—David L. Cavanaugh
*Attorney, Agent, or Firm*—Barnes, Kisselle, Raisch, Choate, Whittemore & Hulbert

[57] ABSTRACT

A vane-type rotary hydraulic machine that comprises a housing, a rotor mounted within the housing and having a plurality of radially extending peripheral slots, and a plurality of vanes individually slidably mounted in the rotor slots. A cam ring within the housing surrounds the rotor and has a radially inwardly directed surface forming a track for sliding engagement with the vanes. Symmetrical diametrically opposed fluid pressure cavities are formed between the cam ring surface and the rotor, and fluid inlet and outlet passages in the housing are coupled to the fluid pressure cavities. Both of the fluid inlet and outlet passages comprise housing fluid passages that open to side faces of the rotor radially inwardly of the fluid pressure cavities, and fluid passages extending radially through the rotor between outer ends opening at the periphery of the rotor between adjacent slots and an inner end opening axially at the side faces of the rotor for communication with the housing fluid passage as a function of rotation of the rotor.

5 Claims, 5 Drawing Sheets

PUMP INLET
PUMP DISCHARGE
UNDERVANE PRESSURE
ROTATION (DEGREES)
0
20
40
60
80
100
120
140
160
180
200

BALANCED DUAL-LOBE VANE PUMP WITH RADIAL INLET AND OUTLET PARTING THROUGH THE PUMP ROTOR

This is a continuation of copending application Ser. No. 07/356,228 filed on May 24, 1989, now abandoned.

The present invention is directed to sliding-vane rotary hydraulic machines capable of functioning as pumps, motors, flow dividers, pressure intensifiers and the like, and more particularly to a balanced dual-lobe machine having enhanced fluid inlet and outlet characteristics and having particular utility for gas turbine aircraft engine fuel pump applications.

BACKGROUND AND OBJECTS OF THE INVENTION

Rotary hydraulic machines of the subject type generally include a housing, a rotor mounted for rotation within the housing, and a plurality of vanes individually slidably disposed in corresponding radially-extending peripheral slots in the rotor. A cam ring radially surrounds the rotor, and has an inwardly directed surface forming a vane track and one or more fluid pressure cavities between the cam surface and the rotor. Inlet and outlet passages in the housing feed hydraulic fluid to and from the fluid pressure cavities.

The fluid inlet and outlet ports typically open directly into the fluid pressure cavities at the edges of the vane track. The vane outer edges are thus susceptible to chipping and damage where exposed to edges of the fluid ports. Further, in gas turbine aircraft engine pump applications, as rated pump speeds are increased, the fluid inlet port becomes smaller making inlet fuel pressure critical. It has been proposed to tailor the outside diameter of the rotor to obtain additional inlet area. However, this technique exposes the vanes to increased stress, and thus exacerbates susceptibility of the vanes to damage. Indeed, it has been found that most vane pump failures are caused by chipping or breaking of the vanes on the fluid ports or windows where the vane edges are exposed.

It is therefore a general object of the present invention to provide a rotary hydraulic machine of the subject type that eliminates porting of inlet and outlet fluid directly to the fluid pressure cavities, and thereby eliminates this cause of potential vane damage and machine failure. Yet another object of the present invention is to provide a machine of the described type, having particular utility in gas turbine aircraft engine fuel pump applications, that exhibits enhanced fluid inlet characteristics as compared with corresponding machines of similar type in the prior art. In addressing the foregoing objective, it is yet another and more specific object of the invention to provide a rotary hydraulic machine of the subject type in which fuel inlet passages are constructed to cooperate with rotation of the rotor for boosting inlet flow and pressure.

SUMMARY OF THE INVENTION

The present invention contemplates a vane-type rotary hydraulic machine that comprises a housing, a rotor mounted within the housing and having a plurality of radially extending peripheral slots, and a plurality of vanes individually slidably mounted in the rotor slots. A cam ring within the housing surrounds the rotor and has a radially inwardly directed surface forming a track for sliding engagement with the vanes. At least one fluid pressure cavity is formed between the cam ring surface and the rotor, and fluid inlet and outlet passages in the housing are coupled to the fluid pressure cavity. In accordance with a distinguishing feature of the present invention, at least one and preferably both of the fluid inlet and outlet passages comprise housing fluid passages that open to a side face of the rotor radially inwardly of the fluid pressure cavity, and fluid passages extending radially the tough the rotor between outer ends opening at the periphery of the rotor between adjacent slots and inner ends opening axially at the side face of the rotor for communication with the housing fluid passage as a function of rotation of the rotor.

The rotor fluid passages preferably comprise a plurality of first passages extending axially through the rotor body between the rotor side faces, and a corresponding plurality of second passages extending from the first passages to the rotor periphery mid-way between adjacent rotor vane slots. The fluid inlet includes a housing passage that opens to a kidney-shaped slot adjacent to one or, preferably, both of the rotor side faces. The rotor thus acts as an impeller in which centrifugal forces of rotation effectively pump fluid to the pressure cavities, and thereby enhance fluid inlet characteristics. The fluid outlet likewise comprises a housing passage that terminates in a kidney-shaped opening adjacent to one, and preferably both, of the rotor side faces. Thus, the rotor passages function as both inlet and outlet passages for feeding fluid to and from the pressure cavity as the rotor rotates, and the rotor vanes encounter no sharp edges during rotation that might chip and damage the opposing vane edges. Each of the kidney-shaped openings is dimensioned to communicate with at least two of the rotor passages.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

Figure 1:
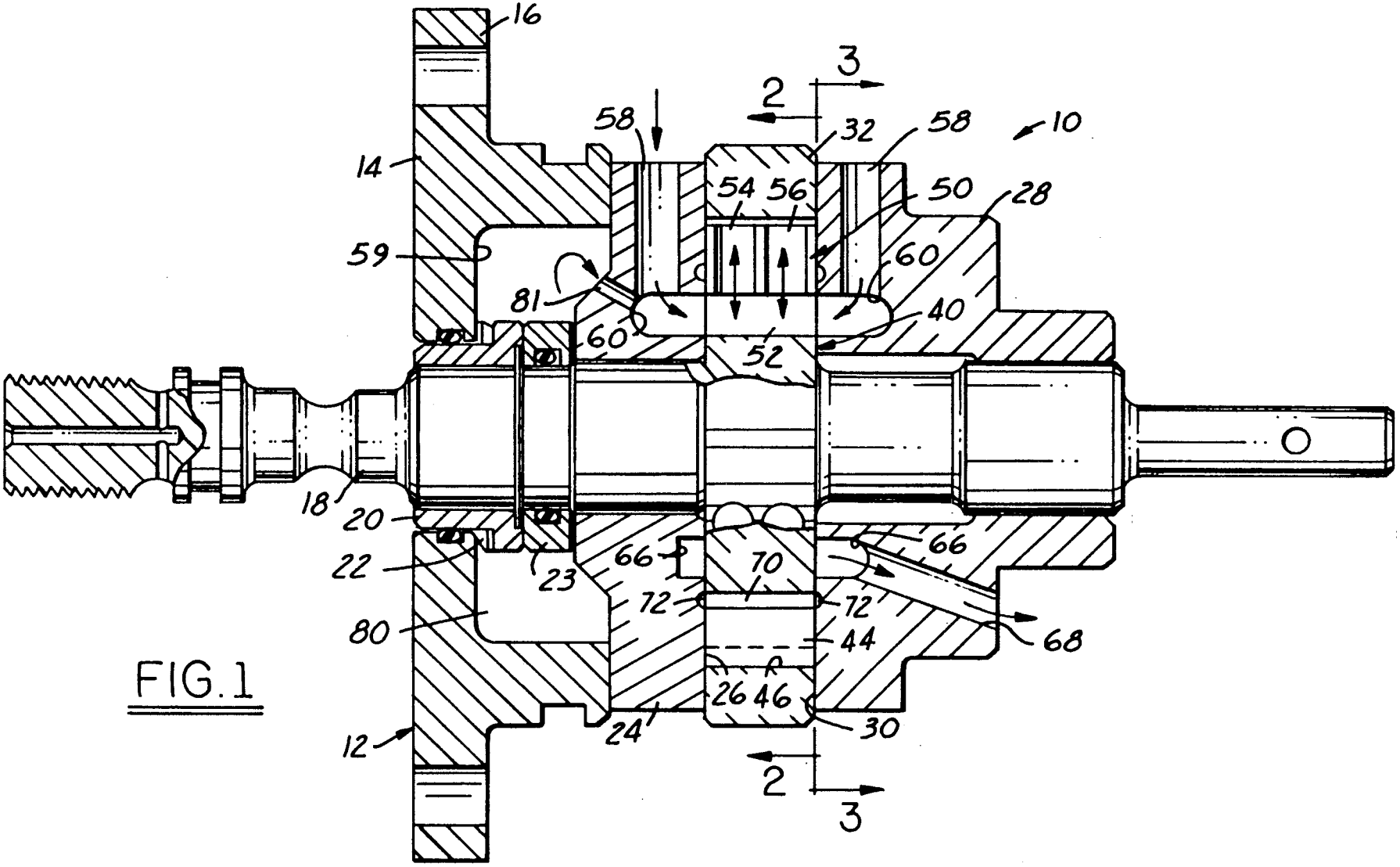
FIG. 1 is a sectioned side elevational view of a balanced dual-lobe gas turbin aircraft engine fuel pump in accordance with a presently preferred embodiment of the invention.

The drawings illustrate a balanced dual-lobe aircraft gas turbine engine vane-type fuel pump 10 in accordance with a presently preferred implementation of the invention as comprising a housing 12 that includes a cover 14 with a radially extending flange 16 for mounting pump 10 to suitable pump-support structure (not shown). A pump drive shaft 18 is rotatably supported within housing 12 by pressure plates 24, 28. A sealing ring 20 surrounds shaft 18 within cover 14, with a spring washer 22 being captured in compression between the flange on ring 20 and an opposing surface of cover 14 to urge ring 20 against a mating ring 23. A front pressure plate 24 surrounds shaft 14 and has an axially facing flat surface 26 remote from cover 14. A rear pressure plate 28 surrounds shaft 18 and is affixed to housing 12 (by means not shown), with a flat pressure plate face 30 being positioned in parallel spaced opposition to face 26.

Figure 5:
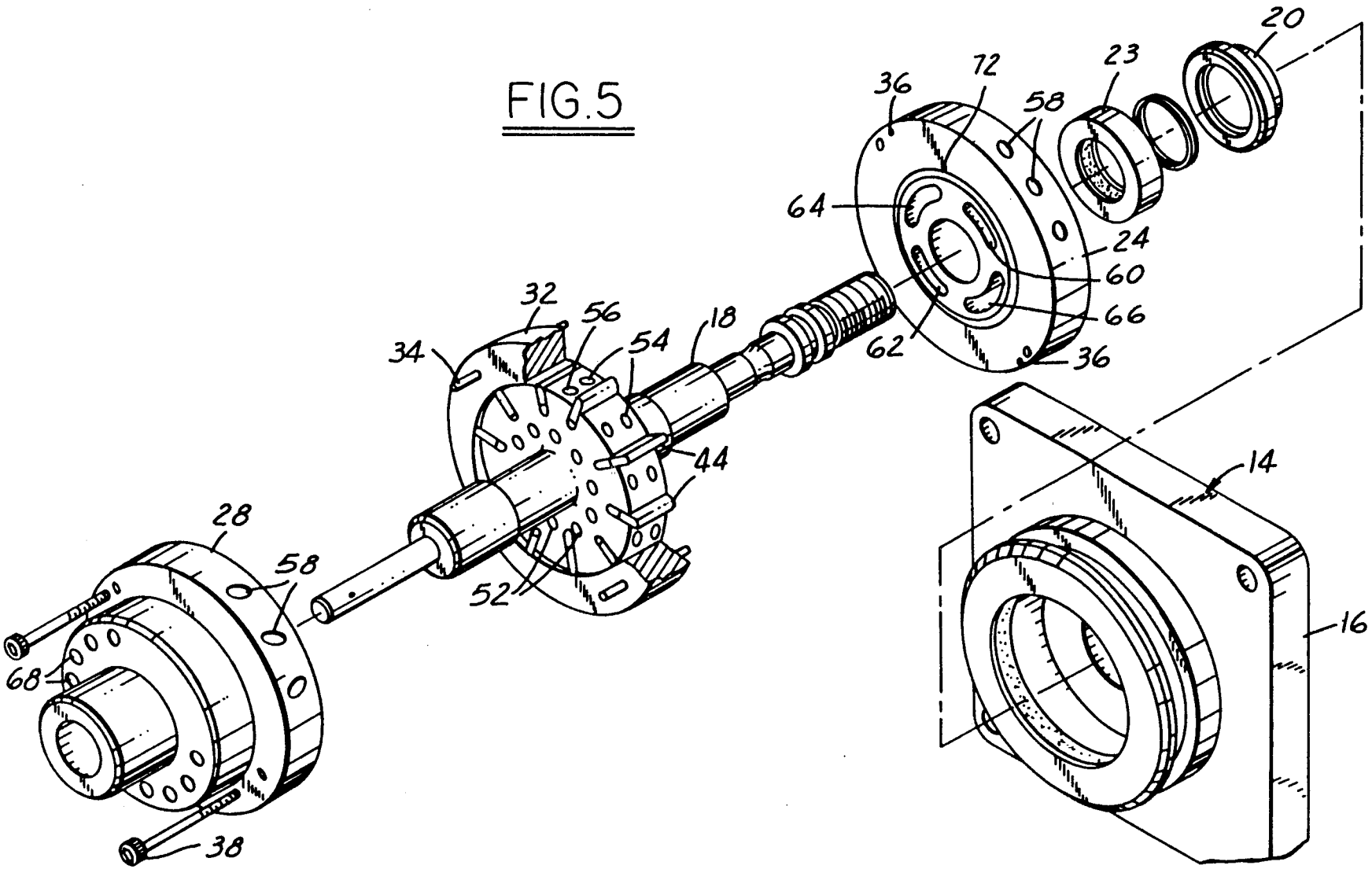
FIG. 5 is an exploded perspective view of the pump in FIGS. 1-3.

A cam ring 32 is captured between pressure plates 24, 28, with a circumferential array of pins 34 (FIGS. 2, 3 and 5) extending axially from the sides of cam ring 32 into opposed openings 36 of pressure plates 24, 28 and thereby circumferentially aligning the cam ring and pressure plates. An array of screws 38 mount the pressure plates and cam ring in assembly. The pressure plates and cam ring thus form a rotor cavity in which a rotor 40 is positioned. Rotor 40 is rotatably coupled to shaft 18 and has a uniformly spaced circumferential array of peripheral slots 42 is which a corresponding array of vanes 44 are slidably received. The radially inner surface 46 of cam ring 32 is contoured to form a diametrically opposed symmetrical pair of fluid pressure cavities 48 between cam ring surface 46 and the opposing periphery of rotor 40. A plurality of fluid passages 50 extend through the body of rotor 40 and are positioned in a uniformly spaced circumferential array, with one passage 50 being positioned mid-way between each adjacent pair of rotor vane slots 42. Each rotor fluid passage 50 includes an axial passage 52 extending entirely through the rotor body, as best seen in FIG. 1, and a number of axially adjacent passages—e.g., two passages 54, 56—that extend radially outwardly from each passage 52 to the periphery of rotor 40. All passages 52 are on a common radius from the axis of rotation of rotor 40 and shaft 18.

The fluid inlet to pump 10 comprises opposed arrays of inlet passages 58 (three shown in FIGS. 1, 3 and 5) that extend radially inwardly from the peripheries of pressure plates 24, 28 to diametrically opposed kidney-shaped inlet channels or openings 60, 62 in each pressure plate. Kidney-shaped openings 60, 62 in the respective pressure plates are in axially aligned opposition to each other, and have a common radius from the axis of shaft rotation equal to the radius of rotor passages 52. Thus, rotor passages 52 register with inlet openings 60, 62 in plates 24, 28 as a function of rotation of the rotor between the plates. Likewise, the fluid outlet of pump 10 comprises a pair of diametrically opposed kidney-shaped slots or openings 64, 66 in each pressure plate 24, 28, each positioned typically mid-way between adjacent inlet openings 60, 62. Openings 64, 66 feed outlet passages 68 (four shown) that extend axially through rear pressure plate 28 or an angle with respect to the shaft axis, as best seen in FIG. 1. Openings 64, 66 are positioned at the radius of rotor openings 52, so that the rotor openings register with outlet openings 64, 66 as a function of rotor rotation. Each opening 60–66 is so dimensioned angularly as to register with at least two rotor openings 52.

A fluid chamber 70 is formed in rotor 40 beneath each vane 44 at a radius to register with a channel 72 that extends entirely around the face 26, 30 of each pressure plate 24, 28. Channel 72 in pressure plate 28 (FIG. 3) communicates through a passage 74 with outlet 68. Thus, undervane fluid pressure urges vanes 44 into engagement with cam ring surface 46. An annular cavity 80 between cover 14 and plate 24 feeds any high pressure fluid leakage around shaft 18 through a passage 81 to kidney-shaped opening 60 in plate 24. A similar passage is provided through port plate 28 to accept leakage around shaft 18 to inlet 58.

Figures 2, 3, 4:
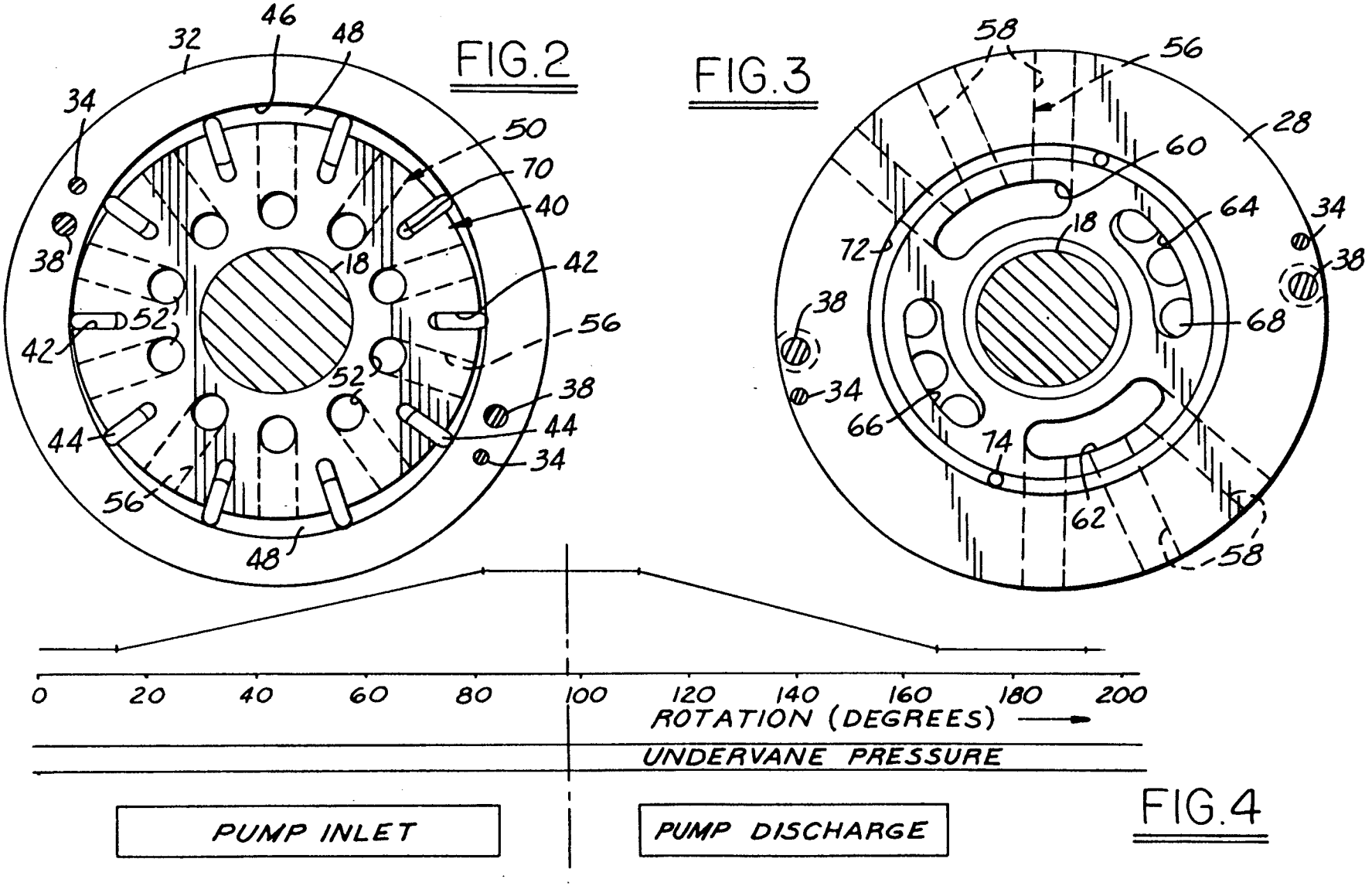
FIGS. 2 and 3 are sectional views taken substantially along the respective lines 2—2 and 3—3 in FIG. 1.
FIG. 4 graphically illustrates a typical inlet and outlet timing diagram for the pump of FIGS. 1-3.

Thus, in accordance with a distinguishing feature of the present invention, inlet fluid is ported to rotor/ring cavities 48 through the pressure plates and the rotor body, rather than directly to the fluid pressure cavities as in the prior art. Furthermore, outlet fluid is ported from the pump fluid pressure cavities through the rotor passages and through the pressure plates, rather than directly from the pump cavities as in the prior art. These features of the invention present at least three distinct advantages. First, absence of fluid ports at or adjacent to the cam ring edges prevents potential damage to the outer edges of vanes 44. Second, as illustrated in FIG. 4, the pump timing inlet arc is greatly extended as compared with the prior art. Specifically, in the disclosed embodiment of the invention, the inlet area arc is extended 18% by timing to the cross holes 52 instead of the space between pairs of vanes as compared with a similar peripherally ported structure, reducing inlet fluid velocity and corresponding fluid wear to the pump. Moreover, centrifugal pumping action during inlet passage through the rotor body greatly increases inlet efficiency.

The contour and arrangement of inlet passages 24, 28 may be of other construction. For example, the inlet passages could extend from cavity 59 (FIG. 1) for other pump designs. Likewise, outlet passages 68 and openings 64, 66 may vary depending upon design requirements. Channel 72 may be of kidney shape (FIG. 7) for permitting vane stroke to participate in pump displacement. Cross holes 52 need not be centered between vane pair as long as they are located consistently in a given design. They may be positioned forward in the direction of rotation to further increase the filling arcs 60, 62.

Figure 6:
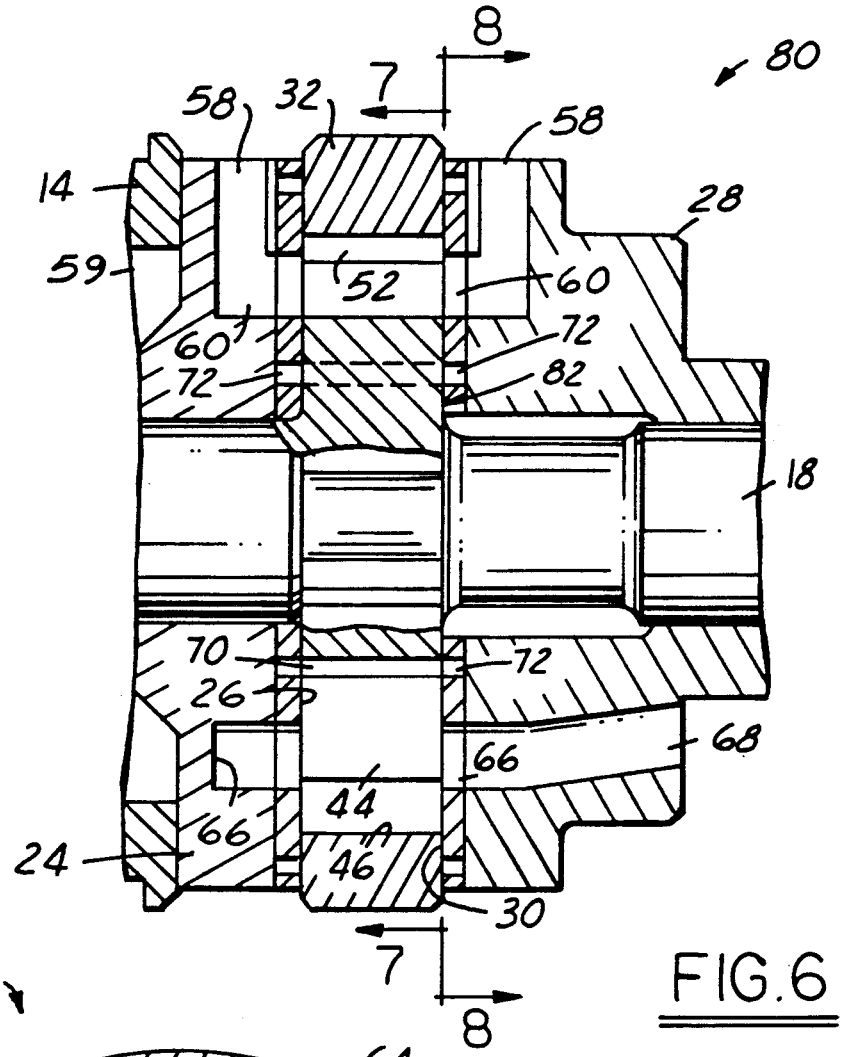
FIG. 6 is a view similar to that of FIG. 1 but showing a modified embodiment of the invention.
Figure 7:
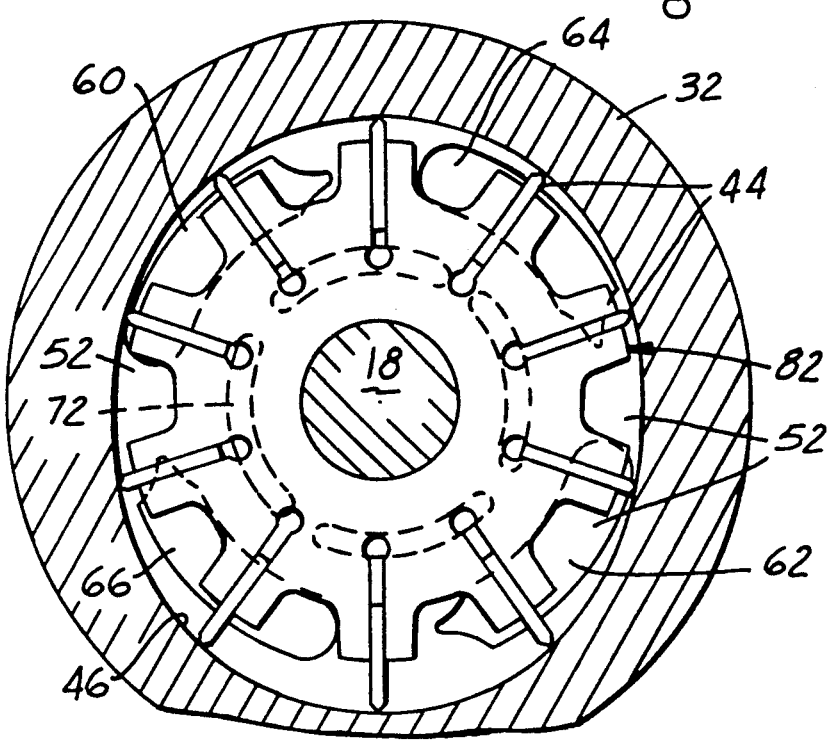
FIGS. 7 and 8 are sectional views taken substantially along the lines 7—7 and 8—8 in FIG. 6.
Figure 8:
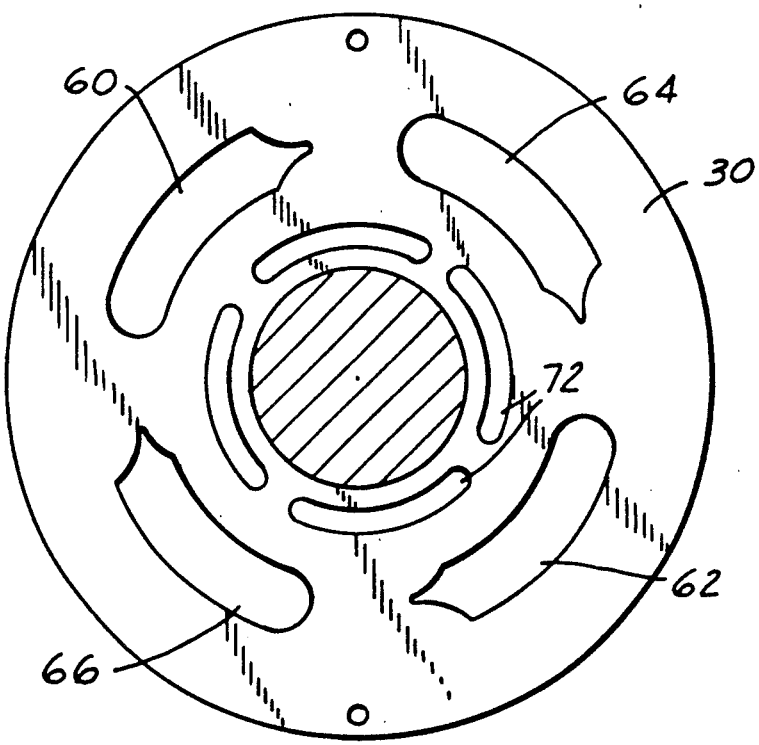

FIGS. 6–8 illustrate a modified pump construction 80 in which cross holes 52 and associated kidneys 60–66 are positioned radially outwardly of channel 72 to reduce pump package size. Radial holes 54, 56 are formed by breakout of cross hole 52 to the outer diameter of rotor 82. Vanes 44 are guided on both ends, which protects them from any foreign particles in the inlet fluid. Kidneys 60–66 are shaped to affect a transition of pressure in the pumping chambers 48—i.e., compression of the fluid when going from inlet to discharge and decompressing when going from discharge to inlet to repeat the pumping cycle.

I claim:

1. A balanced dual-lobe rotary hydraulic machine that comprises:

a housing including a pair of plates mounted against rotation within said housing and having opposed flat parallel faces forming a rotor cavity;

a rotor mounted for rotation about a fixed axis within said cavity and having flat parallel side faces opposed to said plate faces, a plurality of radially extending peripheral slots, a plurality of vanes individually slidably mounted in said slots, and a plurality of passages extending radially through said rotor between said slots, each of said passages having an outer end opening at the periphery of said rotor between an adjacent pair of said slots and a pair of inner ends opening at respective ones of said rotor side faces, said open inner ends being at uniform identical radius from said axis on said side faces, a cam ring mounted against rotation within said housing radially surrounding said rotor and having a radially inwardly directed surface forming a vane track and a pair of symmetrical diametrically opposed fluid pressure cavities between said surface and said rotor, a fluid inlet including a pair of inlet passages in said housing extending through each of said plates and forming identical diametrically opposed kidney-shaped openings in each of said plate faces, said inlet openings in each of said plate faces being identical and opposed to the inlet openings in the opposing plate face and at uniform radius from said axis equal to said radius of said open inner passage ends so as to be positioned to register with said inner passage ends in said rotor side faces, and a fluid outlet including a pair of outlet passages in said housing extending through each of said plates and forming identical diametrically opposed kidney-shaped openings in each of said plate faces, said outlet openings in each of said plate faces being identical and opposed to outlet openings in the opposing plate face and at uniform radius from said axis equal to said radius of said open inner passages ends so as to be positioned to register with said inner passage ends in said rotor side faces.

2. The machine set forth in claim 1 wherein said kidney-shaped openings at said rotor side faces are dimensioned to communicate with at least two of said passage inner ends in said rotor.

3. The machine set forth in claim 1 wherein said rotor passages each include a first portion extending axially through said rotor between said side faces, and a second portion extending radially from said first portion to an associated outer end at said periphery, each of said first portion being radially aligned with the associated open outer end and with the associated second portion of the passage.

4. The machine set forth in claim 3 wherein each said second portion is positioned mid-way between an adjacent pair of said slots.

5. The machine set forth in claim 4 wherein each said rotor passage includes a pair of said second portions positioned axially adjacent to each other.

* * * * *